United States Patent [19]

Lagow

[11] Patent Number: 4,603,554

[45] Date of Patent: Aug. 5, 1986

[54] METHOD AND APPARATUS FOR EXTRACTING USEFUL ENERGY FROM A SUPERHEATED VAPOR ACTUATED POWER GENERATING DEVICE

[75] Inventor: Ralph J. Lagow, Anahuac, Tex.

[73] Assignee: Thermal Engine Technology, Houston, Tex.

[21] Appl. No.: 664,792

[22] Filed: Oct. 25, 1984

[51] Int. Cl.[4] ..... F01K 11/00; F01K 21/00

[52] U.S. Cl. ..... 60/670; 60/692; 60/669

[58] Field of Search ..... 60/651, 671, 690, 692, 60/670, 669

[56] References Cited

U.S. PATENT DOCUMENTS

| | | | |
|---|---|---|---|
| 451,342 | 4/1891 | De Susini . | |
| 514,573 | 2/1894 | De Susini . | |
| 670,829 | 3/1901 | Windhausen . | |
| 756,785 | 4/1904 | Fraley . | |
| 982,449 | 1/1911 | Timmins . | |
| 3,287,901 | 11/1966 | Tauer | 60/671 |
| 3,531,933 | 10/1970 | Baldwin . | |
| 3,950,949 | 4/1976 | Martin et al. . | |
| 3,967,450 | 7/1976 | Girardier . | |
| 4,018,581 | 4/1977 | Ruff et al. . | |
| 4,033,136 | 7/1977 | Stewart . | |
| 4,068,476 | 1/1978 | Kelsey . | |
| 4,102,133 | 7/1978 | Anderson . | |
| 4,106,581 | 8/1978 | West et al. . | |
| 4,109,468 | 8/1978 | Heath . | |
| 4,156,343 | 5/1979 | Stewart . | |
| 4,209,992 | 7/1970 | Chih-Kang . | |
| 4,285,201 | 8/1981 | Stewart . | |
| 4,354,565 | 10/1982 | Latter et al. . | |
| 4,424,678 | 1/1984 | Kizziah . | |

*Primary Examiner*—Allen M. Ostrager

*Attorney, Agent, or Firm*—Arnold, White & Durkee

[57] ABSTRACT

The invention disclosed herein relates to an improved method and apparatus for extracting useful energy from the superheated vapor of a working fluid by a vapor actuated power generating device. The apparatus utilized includes a high pressure vessel which receives a superheated vapor and contains one or more positive displacement piston and cylinder assemblies connected to a rotational output shaft with the top face of each piston directly connected to a larger piston and cylinder assembly which operates at lower pressure and is contained within one of the low pressure sections of the apparatus which also serves as the condenser. The low pressure piston is axially connected to an injector piston and cylinder assembly also located within the same low pressure section which transfers liquefied working fluid to heat absorption cells for acquiring sufficient heat to vaporize and superheat the working fluid for recycling.

19 Claims, 9 Drawing Figures

METHOD AND APPARATUS FOR EXTRACTING USEFUL ENERGY FROM A SUPERHEATED VAPOR ACTUATED POWER GENERATING DEVICE

BACKGROUND OF THE INVENTION

1. Field of the Invention

Vapor actuated power generating device.

2. Description of the Prior Art

Superheated vapor actuated power generating devices in the past have extracted the energy of a working fluid which had been sufficiently heated to generate the superheated vapor phase of the working fluid by sequentially expanding the superheated vapor, isentropically discharging the vapor to a condenser for liquefaction, converting the extracted energy to useful work such as rotational output, and utilizing a portion of the rotational output to transfer the liquefied working fluid to means for reheating the working fluid and repeating the cycle.

A major object of the present invention is to provide a mechanical structure which minimizes or eliminates inherent inefficiencies of the prior art and enhances the method of extracting and converting the useful work output of vapor actuated power generating device.

SUMMARY OF THE INVENTION

The present superheated vapor power generating device consists of a high pressure vessel and one or more low pressure vessels each of which contain one or more reciprocating piston and cylinder assemblies which extract energy associated with a superheated working fluid. The high pressure vessel stores superheated vapor of a working fluid at a constant pressure by a supply of superheated vapor from a generating cell of conventional means into the high pressure vessel the flow of which is regulated by means of a conventional pressure and temperature sensitive throttling valve. The high pressure vessel contains one or more high pressure cylinder and piston assemblies and a rotational output shaft with connection means from the high pressure pistons. The bottom face of each high pressure cylinder is directly exposed to the constant high pressure of the superheated vapor within the high pressure vessel volume. The aggregate internal volume of the high pressure cylinders within the high pressure vessel is greatly exceeded by the total volume of the of the high pressure vessel which allows the high pressure to be maintained within the high pressure volume.

Slide valves on the outside periphery of the high pressure cylinders permit the volume contiguous to the top face of the high pressure pistons to selectively be in direct communication with the high pressure volume, be isolated, or be discharged to a lower pressure volume being created by the sweep of a larger diameter low pressure piston which is axially connected to the high pressure piston by a common connecting rod causing it to move in synchronization with the high pressure piston. When the volume contiguous to the top face of the high pressure piston is in communication with the high pressure volume, the pressure on each face of the high pressure piston is equalized resulting in intake of the high pressure superheated vapor with a minimum of negative work being performed. Adiabatic isentropic expansion of the superheated vapor is accomplished by isolating the volume contiguous to the high pressure piston at say 145 degrees of rotation from top dead center of the high pressure pistons travel by activating the slide valve to a closed position. The arrangement of the present invention allows the adiabatic isentropic expansion of the superheated vapor to occur in the isolated cylinder volume contiguous to the top piston face in such a manner as to not overload the adiabatic isentropic expansion process with more heat energy than it can efficiently utilize. When the slide valve is activated at say 180 degrees of rotation from top dead center so as to allow discharge of the expanded vapor to a larger and lower pressure volume contiguous to the top face of the larger diameter low pressure piston, isobaric forces exerted on the bottom side of the high pressure piston by the constant high pressure of the superheated vapor maintained in the high pressure vessel causes movement of the piston toward top dead center or 360 degrees of rotation.

The high pressure piston, low pressure piston and injector piston are rigidly connected by a common connecting rod. As a result of the low pressure piston and cylinder assemblies being located within one of the low pressure vessel volumes which also serves as a system condenser, the top face of the low pressure pistons are subjected to the lowest pressure of the power generating device's closed system. Due to the direct connection of the high and low pressure pistons, the pressure differential from the bottom face of the high pressure piston to the top face of the low pressure is maximized allowing maximum forces to be exerted on the work producing pistons and thereby maximizing efficiency and avoiding unnecessary energy waste needlessly introduced in prior art embodiments.

The volume contiguous to the bottom face of the low pressure piston can be selectively isolated, in direct communication with the discharge of the top volume contiguous to the face of the high pressure piston, or exhausted directly to the low pressure vessel volume/-condenser with the use of a similar slide valve as used on the high pressure pistons. When the slide valve is actuated so as to receive the discharge from the volume contiguous to the high pressure cylinder, a larger cylinder volume is swept by the larger diameter low pressure piston which creates a lower pressure and results in complete evacuation of the vapor from the volume contiguous to the top face of the high pressure piston. The flow of the vapor from the volume contiguous to the top face of the high pressure piston is caused to expand rapidly within the volume contiguous to the bottom face of the low pressure cylinder as a result of a unique swirl chamber consisting of concave formations of the low pressure piston's bottom face and the low pressure cylinder's end wall thereby also efficiently utilizing the kinetic forces of the vapor flow. When the slide valve is actuated so as to isolate the volume contiguous to the bottom face of the low pressure piston face, further expansion of the working fluid vapor is accomplished through the travel of the piston to top dead center. After this expansion, the slide valve is actuated so as to allow the expanded vapor contiguous to the bottom face of the low pressure cylinder to be exhausted directly to the low pressure vessel/condenser volume and liquefaction of the expanded working vapor is affected by the removal of heat by the condenser. When exhausting to the low pressure vessel/-condenser volume, the pressure differential across the low pressure piston is equalized and discharge of the expanded vapor is to the power generating device's lowest pressure which again minimizes wasted energy.

The injector pistons are also located within one of the low pressure vessel/condenser volume and axially connected to the low pressure piston by the common connecting rod of the high and low pressure pistons. The injector piston draws from the liquefied working fluid reservoir and positively displaces the working fluid to a reservoir with a heat source. With the injector piston and cylinder assembly being located within one of the power generating device's condensers, cavitation and vapor lock experienced in the prior art is completely avoided by the heat removal accomplished by the condenser which surrounds the injector piston and cylinder assembly.

If the working fluid is one of the volatile fluids with a low boiling point, low grade heat sources such as waste or cogenerated, solar, or other similar low grade heat sources can be used singularly or in combination to cause the liquefied working fluid to undergo another phase change to a saturated vapor. A second reservoir and heat source could be used to superheat the saturated vapor with conventional means and controls being used to provide such heat as necessary to provide superheated vapor in sufficient amount and at desired temperature and pressure to maintain operating temperature and pressures within the high pressure volume of the superheated vapor power generating device at optimum levels as determined by working fluid used and quality of available energy.

DESCRIPTION OF THE PREFERRED EMBODIMENT

Figure 1:
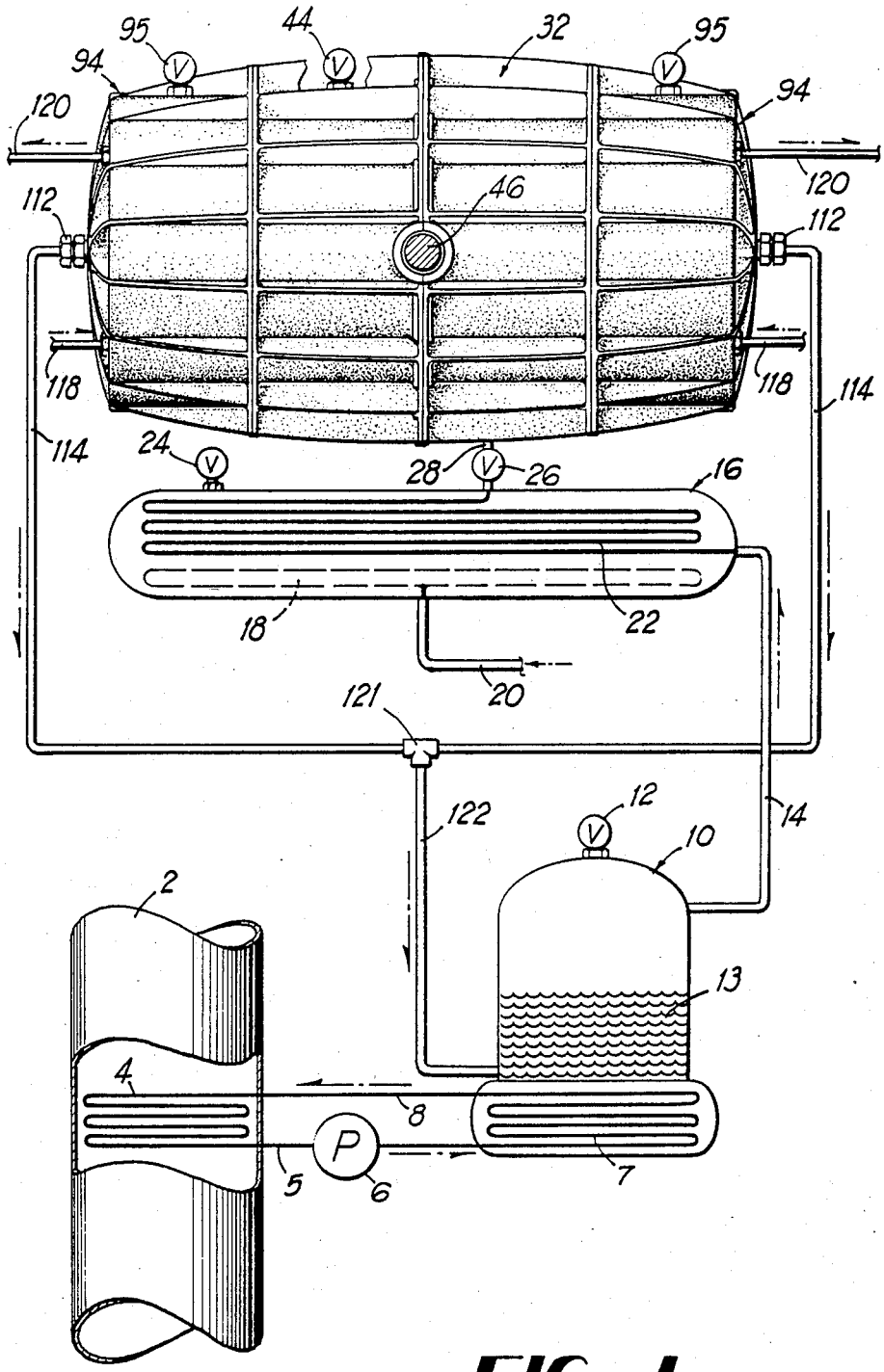
FIG. 1 is a diagrammatic representation of a superheated vapor power actuated generating system utilizing the invention with an exhaust heat source, a burner as the source of superheat, and cooling fluid.

Referring to FIG. 1, a low grade heat source such as an exhaust stack 2 has placed within a heat absorption coil 4 of a closed loop heat transfer means containing a fluid such as water which absorbs a portion of the heat from the heat source when flowed through coil 4 then pumped through line 5 by pump 6 into the heat exchange coils 7 of a saturated vapor generating cell 10 of conventional means equipped with a pressure relief valve 12 and containing a quantity of liquefied working fluid 13 such as Freon which is heated sufficiently by regulating flow rates of pump 6 by conventional means to cause the liquefied working fluid to undergo a phase change to saturated vapor. The heat transfer fluid having given up its heat is recycled to heat source 2 through conduit 8. The saturated vapor of the working fluid flows through conduit 14 into the superheated vapor generating cell 16 equipped with a pressure relief valve 24 and which introduces additional heat supplied and controlled by conventional means such as burners 18, fueled by a fuel source and line 20, and regulated by conventional pressure and temperature controls. The working fluid passes through heating coils 22 picking up sufficient additional heat to become a superheated vapor and pass through throttling valve 26 through conduit 28 into high pressure fitting 30 in the outer shell 32 of the superheated vapor actuated power generating device 32 equipped with a pressure relief valve 44 and rotational power output shaft 46. Exiting from both ends of the low pressure vessel 94 of the superheated vapor actuated power generating device are cooling fluid inlet lines 118 and discharge lines 120. Liquefied working fluid is discharged through pressure fittings 112 into discharge lines 114 into tee fitting 121 and then through conduit 122 into the liquid reservoir of the saturated vapor generating cell 10, completing the closed loop of the working fluid.

Figure 2A:
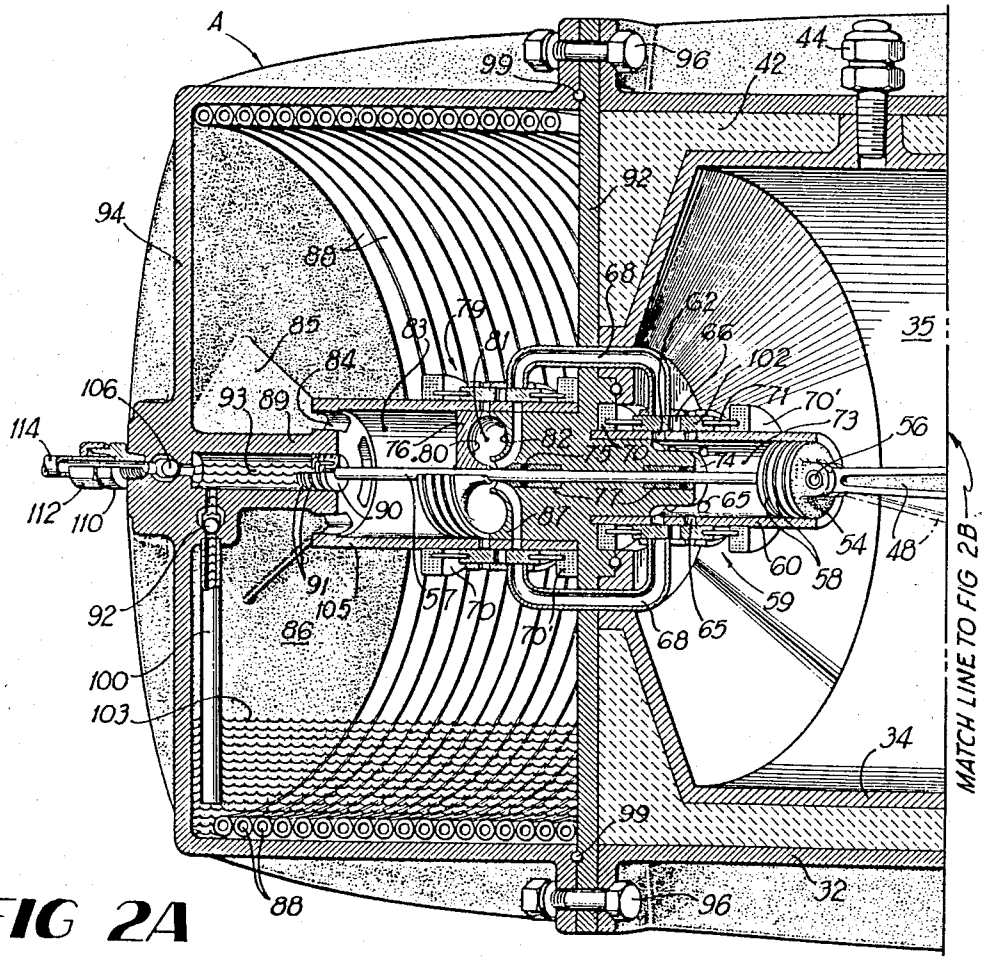
FIGS. 2A and 2B are longitudinal cross-sectioned perspective views of the invention.
Figure 2B:
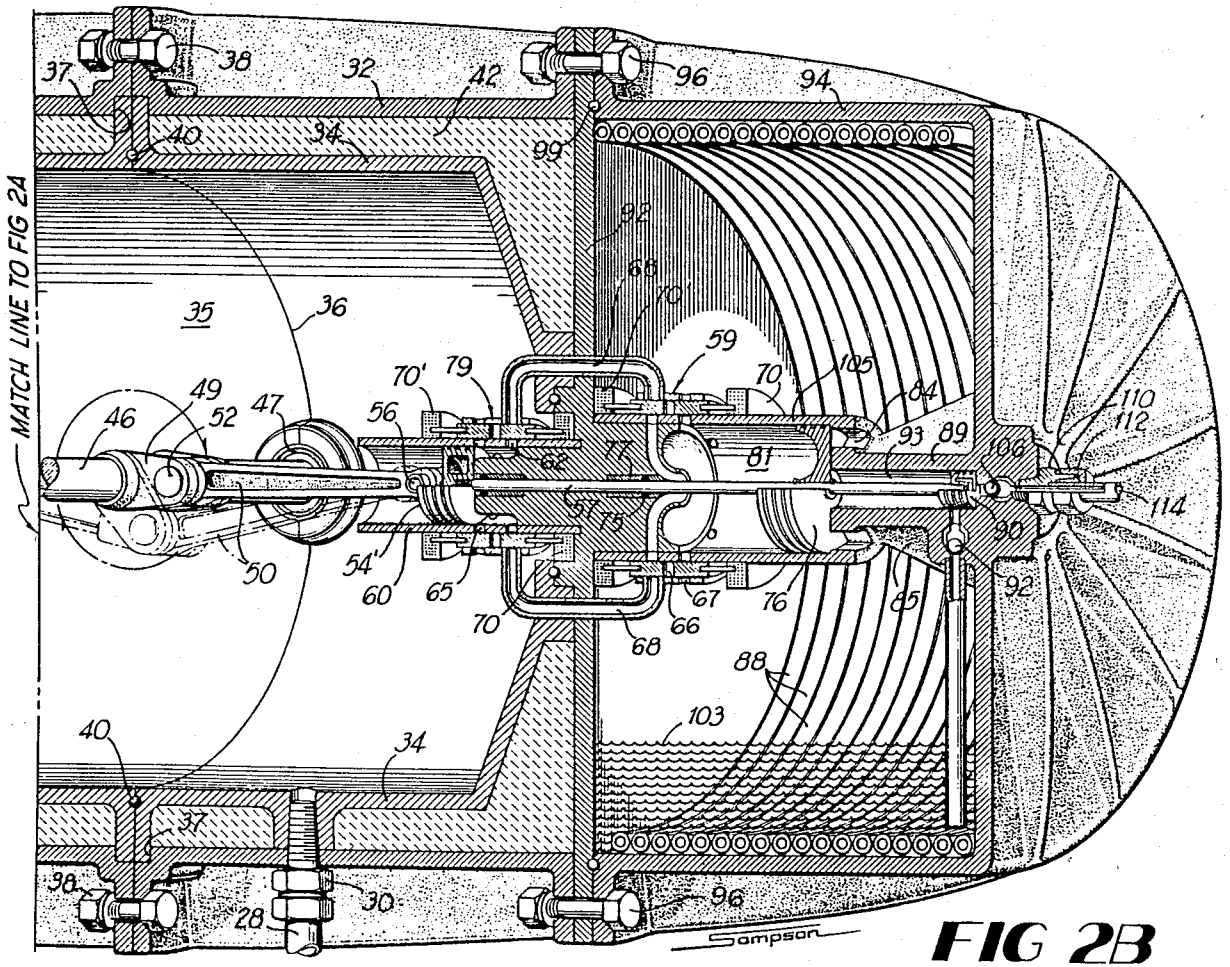
Figure 4:
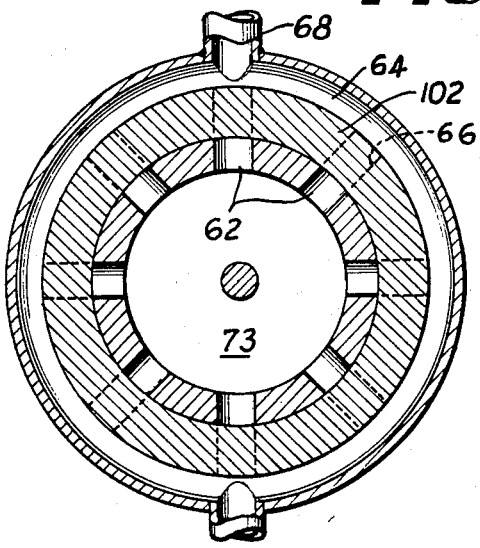
FIG. 4 is a transverse cross-sectional view of the valve assembly taken on the line 4—4 of FIG. 3.
Figure 5:
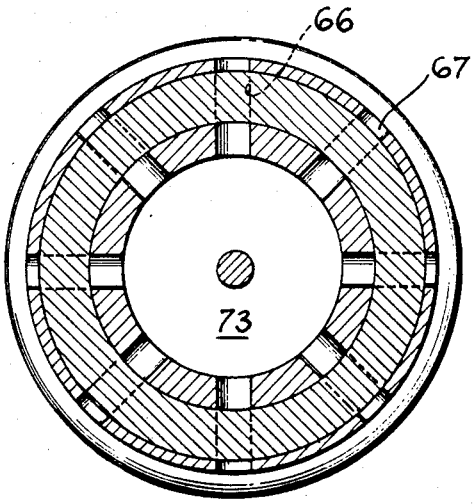
FIG. 5 is a transverse cross-sectional view of the valve assembly taken on the line 5—5 of FIG. 3.

FIG. 2 illustrates the preferred embodiment of the superheated vapor actuated power generating device which comprises an inner cylindrical high pressure vessel formed by left and right walls 34 joined at 36 and sealed by conventional means 40 by seating in a notch 37 formed at the mating surfaces of the right and left sections of the outer shell 32 and mechanically compressed by a plurality of mechanical connections 38 around the exterior of the outer shell. The volume between the outer shell walls 32 and the high pressure vessel walls 34 is filled with a conventional structural and insulating material. Rotational output shaft 46 is journal at bearing 47 and connected to the yoke assembly 49 at the end of piston rod 48. Piston rod 50 is connected at the yoke assembly 49 by means of pin 52. High pressure piston 54 of bank A is connected to piston rod 48 and high pressure piston 54' of bank B is connected to piston rod 50 by means of pins 56. Except for the differences in the yoke connection ends of piston rods 48 and 50, the left bank A of the superheated vapor actuated power generating device and right bank B are mirror images of the other so the description of components apply to either bank. High pressure piston 54 is surrounded by rings 58 within cylinder sleeve 60. The volume 73 contiguous to the top face of high pressure piston 54 is either an isolated volume when communicating port 66 of electromagnetic valve 59 is in its central or closed position, in direct communication with the high pressure volume 35 by the radial alignment of communicating port 66 with the high pressure cylinder sleeve intake ports 65 and valve body ports 67, or in communication with high pressure cylinder discharge conduit 68 by the radial alignment of communicating port 66 with the high pressure cylinder discharge ports 62 and high pressure cylinder discharge conduits 68. By referring to FIG. 4 it can be seen that high pressure cylinder discharge conduits 68 are fed by high pressure cylinder discharge manifold 63 which is in direct communication with the high pressure cylinder volume 73 by a plurality of radial ports 62 when aligned with communicating ports 66. Referring back to FIG 2, in order to minimize the volume 73 contiguous to the high pressure piston 54 when at top dead center of travel and allow communication with high pressure cylinder discharge conduits 68, the end wall of the high pressure cylinder is formed by the elongated cylindrical structure 74. Connecting rods 57 are attached to the top face of high pressure piston 54 and to the low pressure piston 76 with seals 75 and guides 77 surrounding the connecting rods 57.

Exhaust gases from high pressure cylinder volume 73 are evacuated into the varying low pressure cylinder volume 81 contiguous to the bottom face of low pressure piston 76 determined by travel of low pressure piston 76 and caused to swirl within the low pressure cylinder volume 81 by the concave configuration 80 on the bottom face of low pressure piston 76 and the complimentary concave configuration 82 at the end wall of low pressure cylinders 87. The volume 81 contiguous to the bottom face of low pressure piston 76 being increased at a greater rate than the decreasing volume 73 contiguous to the top face of high pressure piston 54 plus the volume of conduits 68 causes a lower pressure resulting in a rapid expansion of working fluid into low pressure cylinder volume 81 resulting in near total evacuation of working fluid from high pressure cylinder volume 73 and the impartation of work on the bottom face of low pressure piston 76 in the form of expansion of the vapor and kinetic energy of the working fluid molecules while the top face of low pressure piston 76 is exposed to the lowest system pressure that occurs within the working fluid system in low pressure vessel volume/condenser 86. Porting into the low pressure cylinder volumes 81 is performed by an electromagnetic valves 79 mechanically similar to electromagnetic valves 59. The volume 83 contiguous to the top face of low pressure piston 76 is directly communicated with low pressure vessel volume/condenser 86 through a plurality of ports 84 in structure 85 which provides structural support for low pressure cylinder sleeve 105 and cylinder sleeve 89 of injector piston 90 with a plurality of piston rings 91. Low pressure vessel wall 94 equipped with pressure relief valve 95 is mechanically attached by conventional means 96 and conventional sealing means 99 at a plurality of flanges to end wall 92. Injector piston 90 is directly connected by axial connecting rod 57 to low pressure piston 76 and high pressure piston 54. As injector piston 90, low pressure piston 76, and high pressure piston 54 travel from top dead center to bottom dead center the vacuu caused by the increasing volume 93 causes check valve 92 to unseat and draw liquefied working fluid 103 through suction tube 100 and into injector volume 93. Upon injector piston 90 travel from bottom dead center to top dead center the increased pressure causes check valve 92 to seat and check valve 106 to unseat causing liquefied working fluid to be forced through pressure fitting 110 through the end wall of low pressure vessel 94 and secured by pressure fitting 112 and through working fluid discharge line 114. Working fluid exhausted into low pressure vessel volume/condenser 86 is cooled and liquefied by heat absorption through condenser tubes 88 by running a sufficient quantity of cooling fluid such as water through condenser tubes 88. Liquefaction of the working fluid decreases pressure to the lowest point in the closed working fluid loop allowing the greatest pressure differential to occur between the bottom face of high pressure piston 54 and the directly linked top face of low pressure piston 76 resulting in working forces applied parallel to the axis of piston movement.

Figure 3:
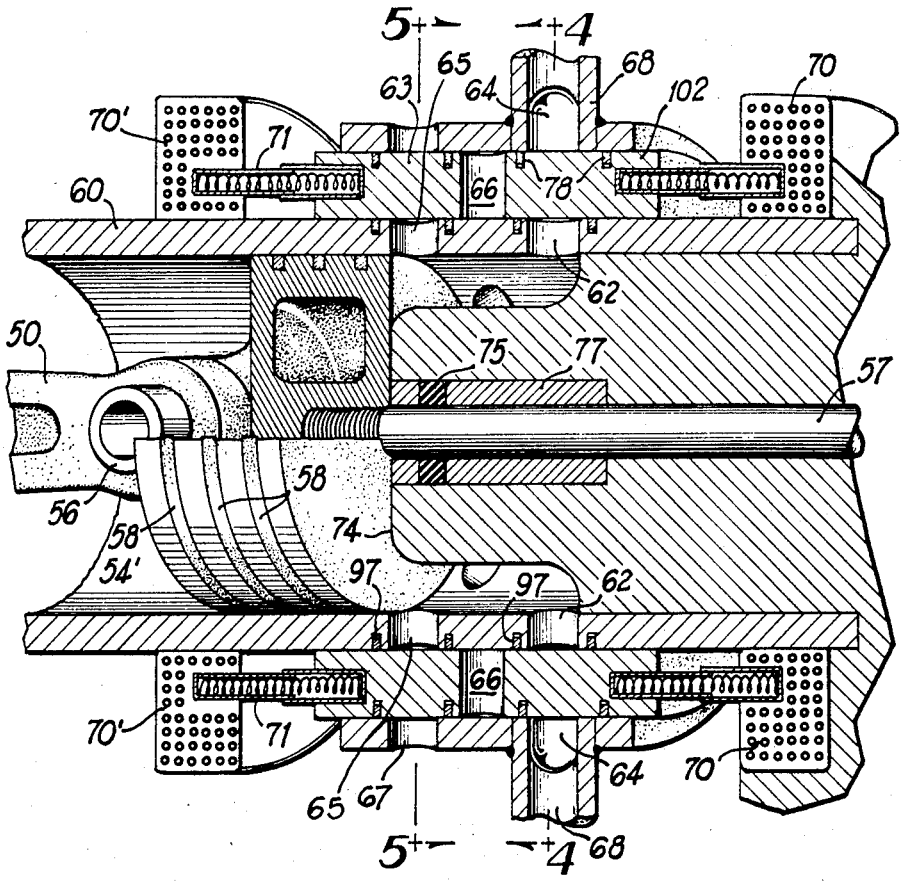
FIG. 3 is a longitudinal cross-sectional view of a valve assembly.

FIG. 3 shows a double action electromagnetic valve assembly 59 which is mechanically similar to electromagnetic valve assembly 79 consisting of coils 70 and 70' encapsulated spring return assemblies 71 and slide valve bumpers 72. In the non-actuated position spring return assemblies 71 positions communicating ports 66 in their neutral or closed position. By activating coil 70 the slide body 102 moves to the right as illustrated in FIG. 3 which radially aligns communicating port 66 with cylinder discharge ports 62 with exhaust manifold 64 which in turn is connected to exhaust conduit 68 when the valve assembly is used in conjunction with high pressure cylinder 54 or to low pressure vessel volume/condenser 86 when used in conjunction with low pressure cylinder 105. Deactivation of coil 70 causes the slide body 102 to return to its closed position by forces exerted by spring return assemblies 71. During activation of coil 70' the slide body 102 moves to the left as illustrated in FIG. 3 and radially aligns communicating ports 66 with cylinder intake ports 65 and valve body discharge ports 67 which communicates with high pressure vessel volume 35 when used in conjunction with high pressure cylinder 54 or to high pressure discharge conduit 68 when used in conjunction with low pressure cylinder 105.

Figure 6:
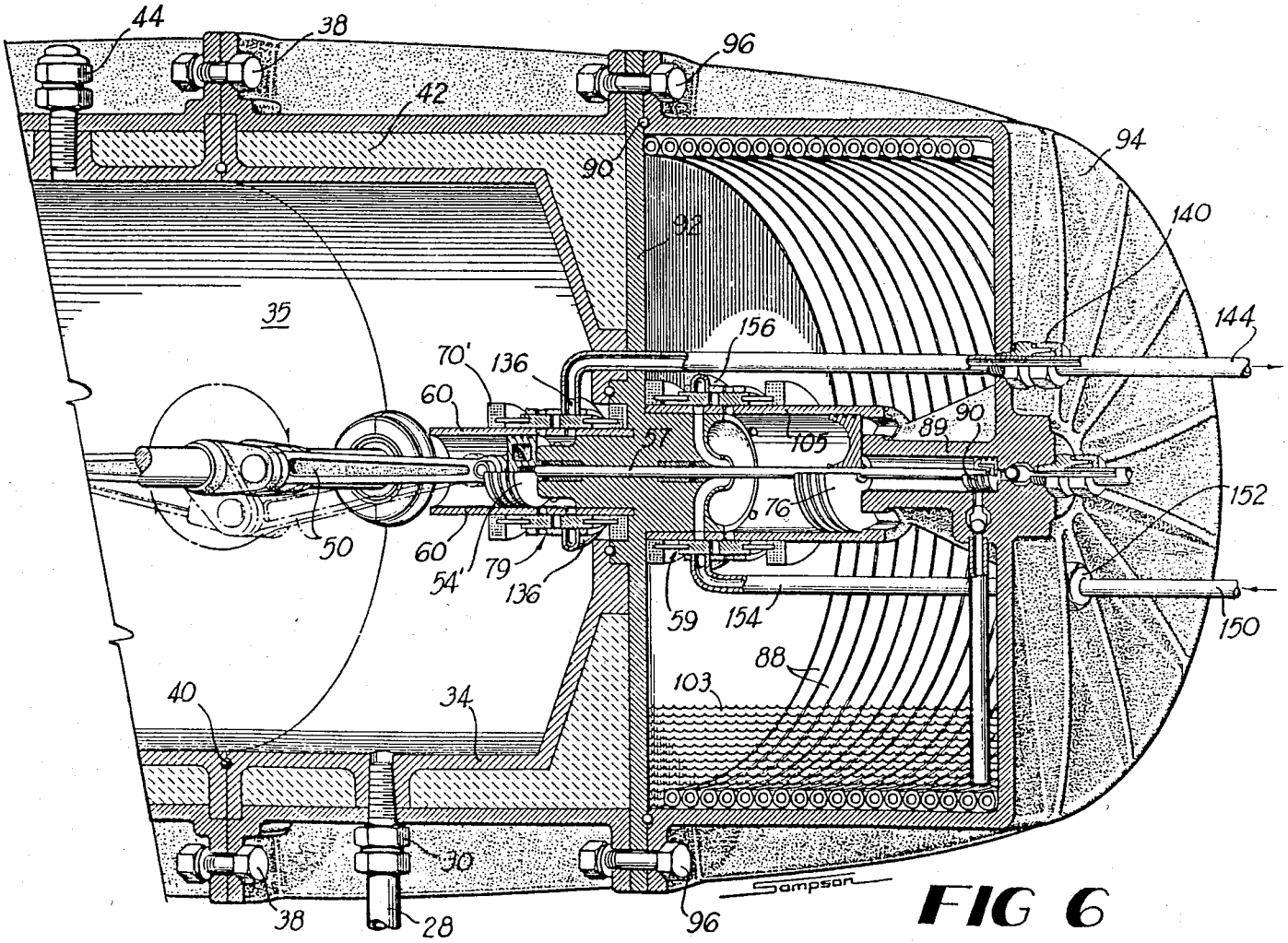
FIG. 6 a partial longitudinal cross-sectioned perspective view of a second embodiment of the invention utilizing a reheat cycle.
Figure 7:
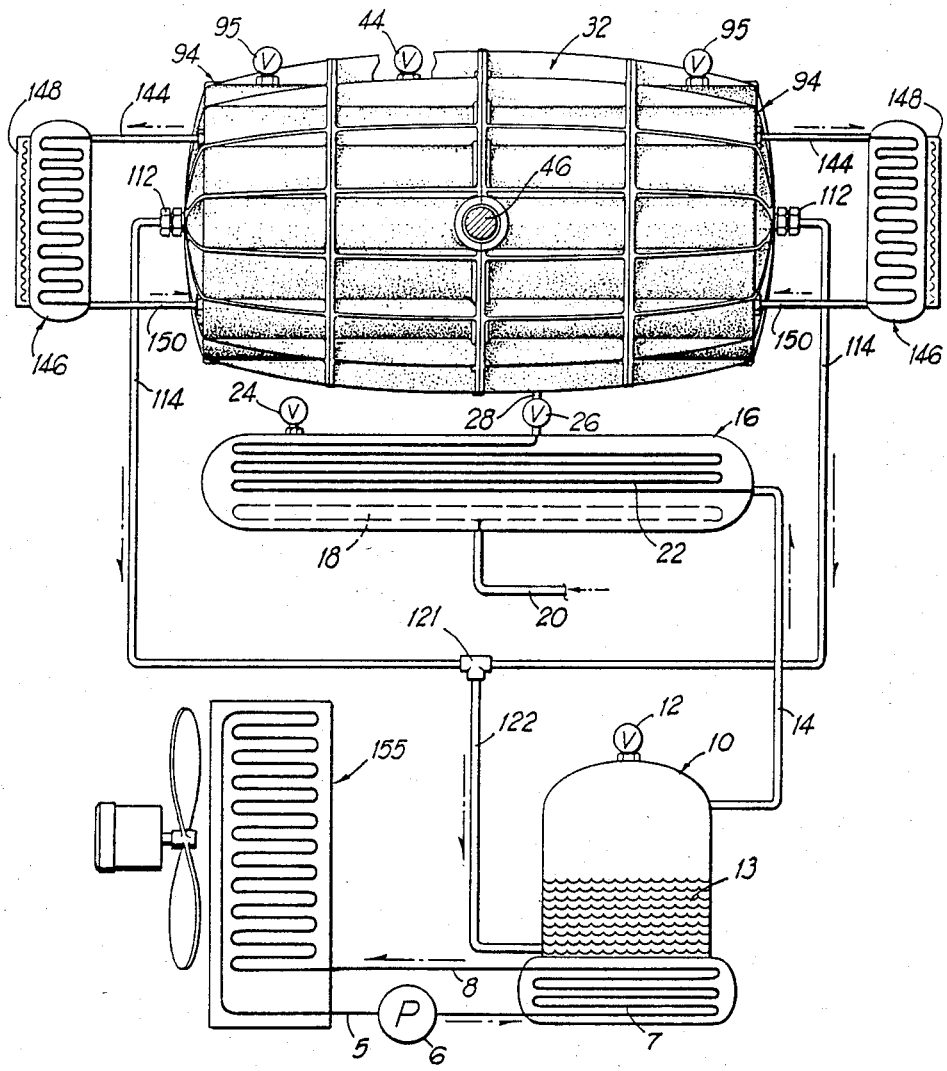
FIG. 7 is a diagrammatic representation of the second embodiment of the invention in a system utilizing a reheat cycle and an alternate heat source.

FIGS. 6 and 7 depict an alternate embodiment of the invention wherein manifold 136 collects exhaust from high pressure cylinder 60 through manifold 136 and transfers by conduit 138 through the end wall of low pressure vessel 94 through pressure fitting 140 through conduit 144 to reheater 146 containing heat element 148 and returned to the low pressure vessel end wall 94 through pressure fitting 152 through conduit 154 into collection manifold 156 which distributes reheated vapor to the intake port of low pressure cylinder 105. Also shown is alternate heat absorption means 155 being air-water heat absorption coil.

Figure 8:
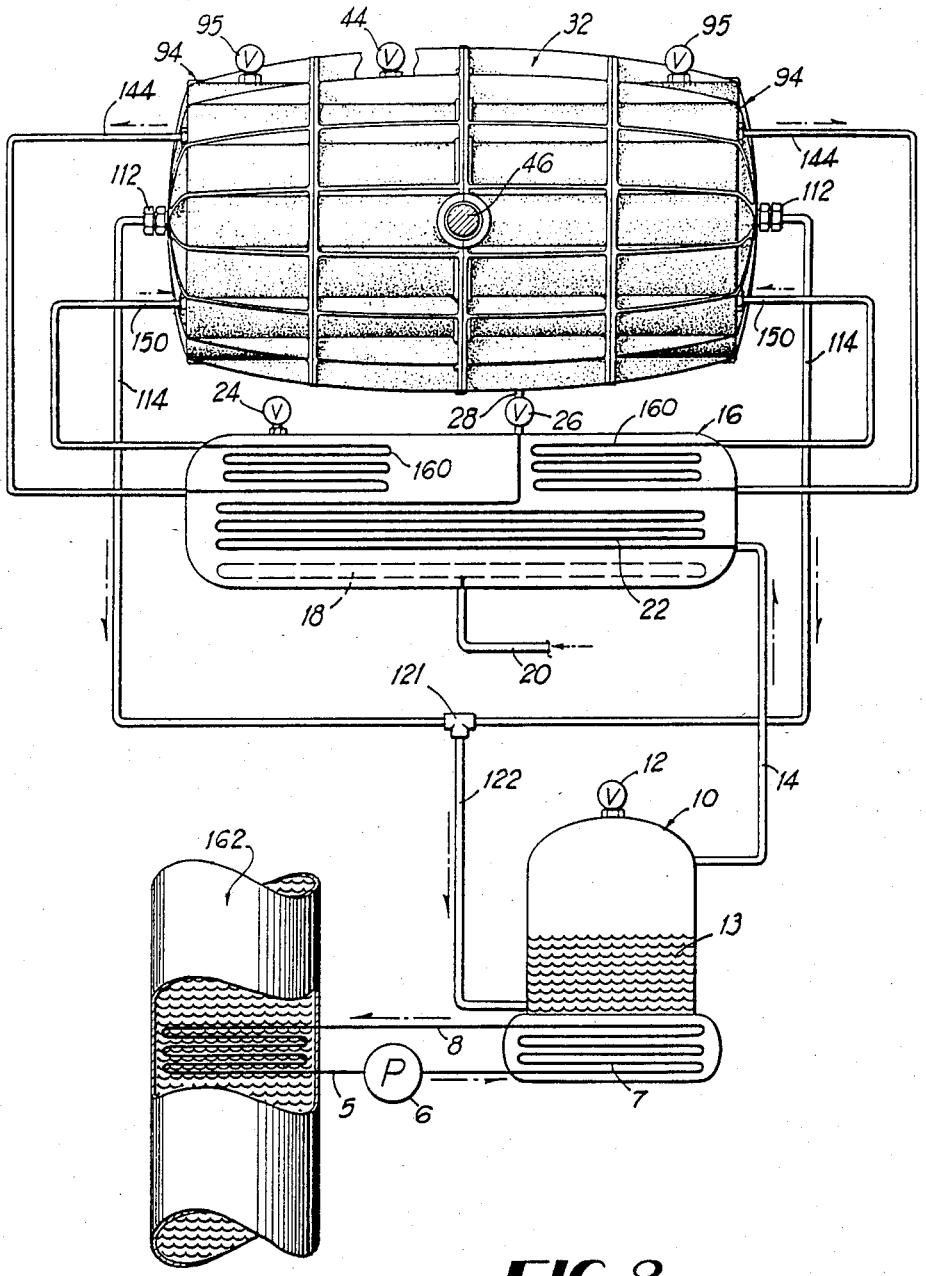
FIG. 8 is a diagrammatic representation of the second embodiment of the invention in a system utilizing the superheater as the reheat source and a second alternate heat source.

FIG. 8 shows a modification wherein conduit 144 is routed through superheat vapor generating cell 16 and heat transfer tubes 160 and returning to the end wall of low pressure vessel 94 through conduit 150. Also shown is an alternate heat source, which is a flow through hot water conduit 162.

I claim:

1. A power generating device comprising:

a source of superheated vapor;

a working shaft;

a high pressure piston and cylinder assembly located at least in part in a high pressure vessel containing superheated vapor, said high pressure piston being operatively linked to the working shaft and said high pressure piston and cylinder assembly being in selective fluid communication with the source of super-heated vapor; and a final stage expansion piston and cylinder assembly located within the confines of a condenser for condensing the superheated vapor, said final stage expansion piston being mechanically linked with the high pressure piston and in selective and separate fluid communication with both the condenser and the high pressure piston and cylinder assembly.

2. A power generating device comprising:

first and second piston in cylinder assemblies located respectively in high pressure and low pressure chambers, said assemblies being in selective intermittent fluid communication with each other through a discharge conduit and mechanically linked along the same axis, said first and second cylinders being configured such that the interior volume of the second cyliner is larger than the interior volume of the first cylinder, and the bottom face of the first piston and the top face of the second piston are continuously exposed to substantially constant high and low pressures, respectively, said discharge conduit and said assemblies being configured to allow formation of an isolated volume of working fluid which may be selectively expanded into the second cylinder from the first cylinder whereby the first piston exposed to the high pressure may produce work through a substantially isobaric process and the second piston exposed to the low pressure may produce work through a substantially isentropic process as the isolated volume expands into the second cylinder.

3. A power generating device comprising:

a first piston having two faces and located in a first cylinder, a portion of the interior of the first cylinder being in selective fluid communication with a high pressure zone;

a working shaft operatively connected to the first piston;

a second piston having two faces and located in a second cylinder, the second piston beign axially and rigidly connected to the first piston by a connecting rod configured to eliminate lateral forces on the second piston caused by the first piston to more effectively transfer reciprocating forces between the first and second pistons, and the interior of the second cylinder being in selective fluid communication with the first cylinder through a discharge conduit and separately in selective fluid communication with a low pressure zone to facilitate sequential pressure changes across the first and second pistons sufficient to move the working shaft.

4. A power generating device according to claim 3 wherein the low pressure zone comprises a condenser adapted to receive a working fluid and wherein the power generating device further comprises a third piston located in a third cylinder and axially aligned with the first and second cylinders, said third cylinder being in selective fluid communication with the low pressure zone to facilitate the removal of working fluid from the low pressure zone.

5. A power generating device according to claim 3 wherein:

the working shaft is rotatably connected to the first piston;

the first and second pistons are moveable from bottom dead center to top dead center in relation to the working shaft;

the top face of the first piston and first cylinder define a first variable volume and the lower face of the second piston and the second cylinder define a second variable volume; and said first and second cylinders and said first and second pistons are configured to allow the second variable volume to increase more rapidly than the first variable volume decreases as the first and second pistons move from the bottom dead center to top dead center in relation to the working shaft.

6. A power generating device according to claim 5 wherein the first and second variable volumes are placed in selective fluid communication by the discharge conduit.

7. A power generating device according to claim 6 wherein the first cylinder has an end wall comprising an elongated generally cylindrical structure configured to facilitate fluid communication between the first variable volume and the discharge conduit while limiting the size of the variable volume.

8. A power generating device according to claim 6 wherein the second cylinder has an end wall comprising a concave surface and wherein the bottom face of the second piston has a concave surface.

9. A power generating device according to claim 4 wherein the low pressure zone comprises a condenser adapted to receive a working fluid and wherein the power generating device further comprises a heat source adapted to supply vaporized working fluid to the high pressure zone.

10. A power generating device according to claim 9 wherein the heat source comprises a low grade heat source.

11. A power generating device according to claim 10 wherein the low grade heat source comprises a solar energy heat source.

12. A power generating device according to claim 10 wherein the low grade heat source comprises an exhaust stack.

13. A power generating device according to claim 9 wherein the power-generating device further comprises at least one vapor generating cell in heat exchange relation with the heat source.

14. A power generating device according to claims 3 or 4 wherein the low pressure zone comprises a condenser adapted to receive a working fluid and wherein the power generating device further comprises:

a low grade heat source;

a saturated vapor generating cell for forming a saturated working vapor, said cell being adapted to receive the working fluid and being in heat exchange relation with the low grade heat source; and a superheated vapor generating cell in fluid communication with the saturated vapor generating cell and in heat exchange relation with a heat source for forming a superheated vapor; said superheated vapor cell also being in fluid communication with the high pressure zone and configured to supply sufficient superheated vapor to maintain a substantially constant pressure in the high pressure zone.

15. A power generating device according to claim 3 further comprising:

a third piston having two faces and located in a first cylinder, at least a portion of the third cylinder being in selective fluid communication with the high pressure zone and said third piston being operatively connected to the working shaft;

a fourth piston having two faces and located in a fourth cylinder, the third cylinder being axially connected to the third piston and the interior of the fourth cylinder being in selective fluid communication with the third cylinder and separately in selective fluid communication with a second low pressure zone to facilitate sequential pressure changes in opposite faces of the third and fourth pistons sufficient to move the working shaft.

16. A power generating device according to claim 15 wherein the third and fourth pistons are axially aligned with the first and second pistons.

17. A power generating device comprising:

a high pressure chamber configured to form a high pressure zone and adapted to receive an at least partially vaporized working fluid;

a low pressure chamber configured to form a low pressure zone and comprising a condenser for the working fluid;

a working shaft journalled into the high pressure chamber and extending therefrom;

a high pressure cylinder extending from an insulating wall of the high pressure chamber and having a high pressure piston slidably sealably mounted therein, said high pressure piston being operably connected to the working shaft by a piston rod to impart rotational motion to the working shaft upon upward and downward movement of the high pressure piston in the high pressure cylinder, and said high pressure piston having upper and lower faces, said lower face being constantly exposed to the high pressure zone and said upper face forming a first variable volume in conjunction with the high pressure cylinder, said high pressure cylinder having at least one opening for selectively exposing the upper face of the high pressure piston to the high pressure zone as the high pressure piston approaches upper dead center in relation to the working shaft;

a low pressure cylinder extending from an insulating wall of the low pressure chamber and having a low pressure piston with lower and upper faces and axially connected to the high pressure piston, the lower face of the low pressure piston forming a second variable volume in conjunction with the low pressure cylinder the second variable volume being in selective fluid communication with the first variable volume by means of at least one discharge conduit; and the upper face of the low pressure piston being in constant fluid communication with the low pressure chamber; said high and low pressure cylinder and pistons and said discharge conduit being respectively configured to allow the second variable volume to increase more rapidly than the first variable volume decreases as the high and low pressure pistons move from bottom dead center to top dead center in relation to the working shaft;

an injection cylinder having an injection piston and extending from a supporting structure in the low pressure chamber; said injection piston being connected to the low pressure piston and axially aligned therewith and said injection cylinder being in fluid communication with the low pressure chamber and configured in conjunction with the injection piston to remove condensed working fluid from the low pressure chamber; and a vapor generating device in heat exchange relation with a heat source, said vapor generating device being adapted to receive condensed working fluid from the injection cylinder and to provide an at least partially vaporized working fluid to the high pressure chamber.

18. A power generating device comprising:

a high pressure vessel configured to form a high pressure zone and adapted to receive at least partially vaporized working fluid;

a low pressure vessel configured to form a low pressure zone and comprising a condenser for the working fluid;

a working shaft;

a high pressure cylinder having a high pressure piston mounted therein, said high pressure piston being operably connected to the working shaft and configured to provide a 180 degree power stroke and said high pressure piston having first and second faces, said second face being constantly exposed to the high pressure zone and said first face forming a first variable volume in conjunction with the high pressure cylinder and said first face being in selective fluid communication with the high pressure zone;

a low pressure cylinder having a low pressure piston with first and second faces and being mechanically linked to the high pressure piston, the first face of the low pressure piston forming a second variable volume in conjunction with the low pressure cylinder, and the second face of the low pressure cylinder being constantly exposed to the low pressure zone; and means for selectively placing the first variable volume in fluid communication with the second variable volume; said high and low pressure cylinder and pistons and said means for selectively placing the variable volumes in fluid communication being configured to allow the second variable volume to increase more rapidly than the first variable volume descreases as the high and low pressure pistons move in relation to the working shaft.

19. A power generating device according to claim 18 wherein the high and low pressure cylinders are in selective fluid communication with each other and wherein said cylinders and said discharge conduit are configured to convey an isolated mass volume from the high pressure cylinder to the low pressure cylinder whereby the isolated mass volume is able to maximize useful work to be alternately produced and transferred to the working shaft by the high and low pressure pistons operating in their respective cylinders during a single 180 degree power stroke.

* * * * *

UNITED STATES PATENT AND TRADEMARK OFFICE

CERTIFICATE OF CORRECTION

PATENT NO. : 4,603,554

DATED : August 5, 1986

INVENTOR(S) : Ralph J. Lagow

It is certified that error appears in the above-identified patent and that said Letters Patent is hereby corrected as shown below:

Column 7, line 25, please delete "beign" and insert therefor --being--.

Column 9, line 33, please insert a --,-- after "cylinder".

Column 10, line 41, please delete "descreases" and insert therefor --decreases--.

Signed and Sealed this

Fourteenth Day of October, 1986

[SEAL]

*Attest:*

DONALD J. QUIGG

*Attesting Officer*

*Commissioner of Patents and Trademarks*